US006817871B2

(12) United States Patent
Hedrick et al.

(10) Patent No.: US 6,817,871 B2
(45) Date of Patent: Nov. 16, 2004

(54) LOCKING ELECTRICAL RECEPTACLE

(75) Inventors: Paul Hedrick, Alexandria, KY (US); Rick Rimer, Cincinnati, OH (US); Ryan Flaugher, Maineville, OH (US)

(73) Assignee: Multiway Industries, LTD, Hong Kong (CN)

( * ) Notice: Subject to any disclaimer, the term of this patent is extended or adjusted under 35 U.S.C. 154(b) by 0 days.

(21) Appl. No.: 10/197,531

(22) Filed: Jul. 18, 2002

(65) Prior Publication Data

US 2002/0182905 A1 Dec. 5, 2002

Related U.S. Application Data

(62) Division of application No. 09/643,234, filed on Aug. 22, 2000, now Pat. No. 6,454,576.

(51) Int. Cl.[7] ..... H01R 13/648
(52) U.S. Cl. ..... 439/105
(58) Field of Search ..... 439/105, 672, 439/320, 345, 651, 614, 638, 314

(56) References Cited

U.S. PATENT DOCUMENTS

| | | | | | |
|---|---|---|---|---|---|
| 4,206,963 | A | * | 6/1980 | English et al. | 439/581 |
| 4,453,793 | A | | 6/1984 | Panek | 439/968 |
| 4,548,455 | A | | 10/1985 | Ezure | 439/152 |
| 4,605,273 | A | * | 8/1986 | Horton | 439/369 |
| 4,641,899 | A | | 2/1987 | Gallusser et al. | 439/597 |
| 4,647,128 | A | | 3/1987 | Maros | 439/350 |
| 4,917,625 | A | * | 4/1990 | Haile | 439/358 |
| 5,286,213 | A | | 2/1994 | Alergott et al. | 439/139 |
| 5,336,103 | A | | 8/1994 | Herboldsheimer | 439/346 |
| 5,344,333 | A | | 9/1994 | Haag | 439/320 |
| 5,393,243 | A | | 2/1995 | Carmo | 439/369 |
| 5,454,729 | A | | 10/1995 | Wen-Te | 439/357 |
| 5,584,720 | A | | 12/1996 | Elswick | 439/369 |
| 5,662,488 | A | | 9/1997 | Alden | 439/314 |
| 5,674,087 | A | | 10/1997 | Kirma | 439/314 |
| 5,722,847 | A | | 3/1998 | Haag | 439/320 |
| 5,755,588 | A | | 5/1998 | Sweatman et al. | 439/369 |
| 5,785,545 | A | | 7/1998 | Holt | 439/352 |
| 5,795,168 | A | | 8/1998 | Duhe | 439/188 |
| D404,008 | S | | 1/1999 | Bennet | D13/137.1 |
| 5,893,772 | A | | 4/1999 | Carmo et al. | 439/346 |
| 5,921,799 | A | | 7/1999 | Forrester | 439/346 |
| 6,056,580 | A | * | 5/2000 | Cross et al. | 439/369 |
| 6,113,410 | A | * | 9/2000 | Heit et al. | 439/321 |

* cited by examiner

*Primary Examiner*—Phuong Dinh
(74) *Attorney, Agent, or Firm*—Frost Brown Todd LLC

(57) ABSTRACT

An AC line power coupling system secures a conventional plug (700) of an appliance cord or extension cord (702). A adapter (400) is fitted onto the prongs (704) of the cord, and semi-permanently attached with a connector (300) including two half housings (301 and 302) that fasten over the plug and a clamp (200) that holds the cord. The adapter prongs mate, which have a conventional layout, with a special socket (600). The adapter is locked onto the socket by a sleeve (500). The sleeve moves relative to the socket, rotating and axially sliding. When the sleeve is slid onto the protruding cylindrical end of the adapter and rotated, lugs on the inside of the sleeve engage in grooves, locking the adapter to the socket; the sleeve motion is reversed to unlock. The adapter can be plugged into conventional sockets while the connector remains fastened over the plug, but when plugged into the special socket and locked, the cord is prevented from pulling out under tension. The special socket can be adapted to junction boxes as well as to power cords.

17 Claims, 4 Drawing Sheets

702
200
301
700
334
434
445
500
645
600
602
610
688
689
302
400
488

500
588
589

VI
510

445
488

300
XIX
XIX 300
488
445
488
688
689
445
689
688
600

600

600
688
689
445
689
688

LOCKING ELECTRICAL RECEPTACLE

This application is a divisional application of non-provisional application Ser. No. 09/643,234, filed Aug. 22, 2000; issued as U.S. Pat. No. 6,454,576 on Sep. 24, 2002; the full disclosure and drawings of which are incorporated by reference herein.

BACKGROUND OF THE INVENTION

1. Field of the Invention

The present invention relates to locking electrical connectors, especially for power cords using the standard two-prong or three-prong arrangement with two straight blade prongs and a round prong for the ground connection on the plug, with a mechanisms or means to prevent the plug from being pulled out of the socket.

2. Description of the Prior Art

A common problem with power tools is that the power is interrupted by the extension cord being pulled out. The prongs of a conventional power plug are held by the female receptacle, or socket, with friction alone. This friction cannot be too great, lest the connection be too difficult to make and disassemble by hand; but the limited friction force cannot hold against ordinary forces on an extension cord which are encountered in the workplace, or elsewhere that electrical appliances are moved or that cords may be pulled on.

Because of the weight of an extension cord, and the friction of the cord's insulation, there is much greater force on the appliance end of an extension cord, or chain of cords, than at the wall socket end. Separation usually occurs at the female end of an extension cord.

Raymond Altergott et al, in U.S. Pat. No. 5,286,213, discloses an extension cord with a socket (female connector) that mates with a standard or conventional male power plug and attempts to secure the male plug, by gripping the prongs of the male plug inside the socket. The gripping is actuated by a cylindrical external sleeve on the socket; rotating the sleeve moves an internal cam mechanism and causes the two terminal blades of the plug to be grasped tightly by internal metal pieces. The tight grip of the metal pieces on the two prongs makes electrical contact and mechanically grasps the prongs to resist pull-out of the plug.

A provisional patent application of Raymond A. Altergott and Thomas P. Masbaum, dated Jul. 21, 1995 and entitled "Locking Electrical Outlet", illustrates in one of the drawing sheets a device very similar to FIG. 1 of the Altergott et al. '213 patent, but without any external cylindrical sleeve. The relative motion is supplied by rotation of an inner socket portion relative to the housing; rather than grasping the housing and the sleeve and rotating them, the housing and plug are grasped and rotated.

An alternate embodiment of Altergott uses the same mechanism as is disclosed in the '213 patent, mounted in a connection box instead of at the end of a power cord.

The Altergott device has several drawbacks. First, the retention force is limited to that of friction; there is no actual locking, because the plug can be pulled by sliding of one surface over another; no part needs to be moved aside, no ledge or step need be overcome, to separate the plug and socket. Second, all separating and bending forces are taken by the prongs, which are not always strongly seated in the body of the plug; the very forces which the device is intended to resist can damage the plug by loosening, bending, or even pulling out the prongs. It would be better if at least part of the force were to be taken by the thick plastic body of the plug, but it is not. Third, the mechanism is complex and, if made to the standards of many electrical fittings, will fail prematurely. The Altergott device is non-repairable.

Haag, in U.S. Pat. Nos. 5,722,847 and 5,344,333, discloses a system of joining power cords which overcomes one drawback of the Altergott device, namely the reliance on prong friction to prevent separation. Haag joins the plug and socket by screw threads. The threads are set on a "face plate" which interacts with a rotatable cylindrical sleeve, that couples housings of the plug (male portion) to the socket (female portion). Haag uses two conical housings with internal parts held in place within by screws inserted through the housing wall in a direction parallel to the axis of the cone. Cylindrical portions extend from the bases of the conical portions, and those cylindrical portions are covered the cylindrical sleeve.

Haag's male and female connectors are custom made. If a regular plug were mated to the female connector, there would be no resistance to separation beyond that of any plug and socket. The Haag patents do not disclose an extension cord that will mate with a conventional male power plug and securely lock to it. Because a special plug is needed for secure locking, there will always be a "weak link" in any chain of power connections. For example, if a user wishes to hook up a hand saw, there will be no more than the usual resistance to pull-out even if the sockets and all extension cords have Haag's custom socket/plug structures, because the drill saw itself will have a conventional plug that can pull out.

The provisional application of Raymond A. Altergott and Thomas P. Masbaum that was mentioned above discloses an extension cord female end and plug each having a cylindrical portion. These two portions align when the connection is made, and form a single cylinder. A cylindrical sleeve, with two pairs of offset lugs protruding from its inner surface, is slidable over the single cylinder. It appears in the drawing that the sleeve locks the socket and plug together with grooves in the surfaces of the cylinders and lugs on the inside of the sleeve, which slide in the grooves, moving between locked and unlocked positions as the lugs slide from one position to another in the grooves.

The male plug of the provisional application is specially made, with the cylindrical portion, and the grooves required for locking, being molded directly into the body of the plug. Like the Haag device, the Altergott/Masbaum device cannot lock the conventional plug of a conventional extension cord, hand drill, etc.

Sweatman et al., in U.S. Pat. No. 5,755,588, discloses a "retention enclosure" which is usable with a conventional plug/socket combination. After the connection is made, the socket and plug are encased inside the enclosure, which includes an upper half and a lower half. The enclosure holds the socket, the plug, and their respective cords merely with friction; there is no positive latch or locking mechanism to prevent the plug from being pulled out.

Sweatman's FIG. 2 shows that the enclosure is long enough that, when the friction grip on the cords is overcome by a force pulling the connection apart, the plug and socket can be pulled into the ends of the enclosure to break the connection. One of Sweatman's objects is accommodate connections "having a variety of sizes and shapes", and thus the shorter connections cannot possible be held securely.

Moreover, the closure mechanism is not only weak (a snap-clasp opposite a live hinge) but it is also located in the center of the enclosure, so that the two halves can be easily sprung apart at either end of the enclosure. This weakness is related to the multiple functions of the housing: it must securely hold, but still be releasable.

Because the Sweatman housing closes over both socket and plug, it must be removed to separate the plug from the socket. Thus, if a worker wishes to change a saw for a drill, for example, he or she must remove the housing entirely, change the appliance plug, and then reassemble the housing over the joined connection. This is awkward and time-consuming, and sooner or later the enclosure will be lost between plug insertions.

The Sweatman device cannot be used with a wall socket because there is no cord attached to the female portion of a wall socket. It can only be used to join one extension cord to another extension cord.

Elswick, in U.S. Pat. No. 5,584,720, discloses a cord plug lock that has an internal compartment just long enough to accommodate the joined pair of socket and plug. At either end is a slot through which the cord can move to the center line, so that the joined socket and plug are held inside. Elswick's device, like Sweatman's, can be lost during plug changes. Elswick illustrates its device with sockets and plugs having rounded ends, which present a definite surface against which the internal end surfaces of Elswick's lock can bear. The more usual plug design has a strain relief, lacks a definite end surface, and could not be made secure by the Elswick device.

The prior art does not disclose a socket or extension cord adapted to accept and securely hold in place a conventional male plug, such as the male plug of a power tool, which permits quick plug changes for various different appliances, which attaches plugs securely without relying on friction forces alone, and which has no loose parts to be lost during plug changes.

SUMMARY OF THE INVENTION

One object of the invention is adapt any conventional power plug to be securely held and quickly exchanged with another plug in a socket, whether the socket is at the end of an extension cord, in a wall, coupled to an appliance, or elsewhere.

Another object is to provide a plug adapter which can be used with conventional sockets and extension cords.

A further object is a plug locking system with no loose parts.

A still further object is to provide a plug connector which can be removed from the plug.

The present invention provides a plug adapter and two means for securing the plug adapter, which are denoted as the lock and the connector. The lock, which should be quickly and easily released, secures the plug adapter to the socket; the second means secures the plug adapter to a conventional plug, and may be semi-permanent or even permanent. The adapter has special features for locking to the socket of the present invention, but it also can be used with a conventional socket such as a common wall outlet or the female end of a conventional extension cord. That is why the connection of the adapter to the plug can be semi-permanent, or permanent; there is no reason to take it off.

The adapter, by separating the two functions of securing and releasing the plug, makes it possible for each function to be done in a better manner.

The preferred lock is actuated by a sliding cylindrical sleeve which is not removable from the socket. It cannot be lost.

With these and other objects, advantages and features of the invention that may become hereinafter apparent, the nature of the invention may be more clearly understood by reference to the following detailed description of the invention, the appended claims and to the several drawings attached herein.

DETAILED DESCRIPTION OF THE INVENTION

Figure 1:
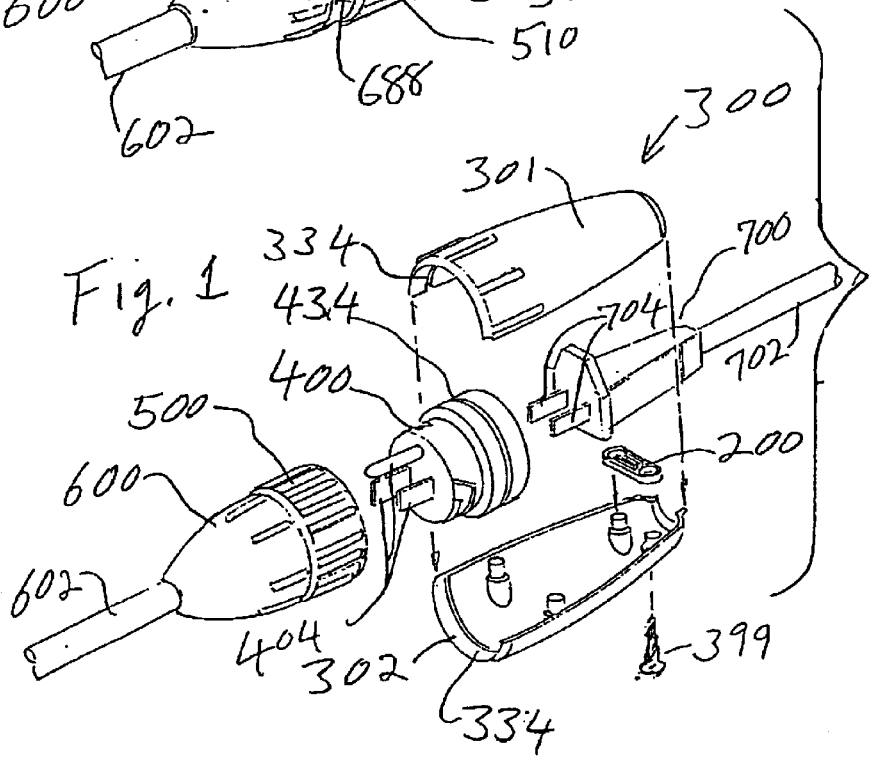
FIG. 1 is an exploded perspective view of the invention.

FIG. 1 shows a preferred embodiment of the present invention, an extension cord system, in overview. A power cord 702 ends in a plug (male connector) 700 having a typical conventional exterior shape. The cord 702 might lead to an appliance such as a power tool, or to a socket (female connector), not shown in FIG. 1. The invention adapts the plug 700 for quick release and locking to a special socket, but does not prevent use with conventional sockets.

Two prongs (terminal blades) 704 extend from a face on the body of the plug 700, and these insert into mating receptacles (not visible in FIG. 1) in an adapter 400. The adapter 400 has prongs 404, internally connected, which receive the prongs 704 of the plug 700, which in turn engage with mating receptacles (not visible in FIG. 1) in socket 600 connected at the end of a cable 602. These are internally connected to the conductors in the cable 602, so that power can flow between the cable 602 and the cord 702.

A connector joins the plug 700 to the adapter 400. The preferred embodiment includes two half-housings 301 and 302, which together make up a connection housing 300. The halves 301 and 302 are shown exploded away from their positions surrounding the adapter 400 and the plug 700. In their assembled position (shown in FIG. 3) the housing halves 301 and 302 are preferably held together by self-tapping screws 399. FIG. 1 shows an internal annular flange 334 of the connection housing 300, which fits into an annular groove 434 of the adapter 400.

On the end of the socket 600 opposite to the cable 602 is a coupling sleeve 500, which is slidable and rotatable on a cylindrical portion of the socket 600, called the first barrel. The first barrel is partially visible in FIG. 3, where the sleeve 500 is in its locking position, moved away from the cable 602. The action of the coupling sleeve will be described below.

A cord clamp 200 is shown exploded out of the half-housing 302.

Figure 2:
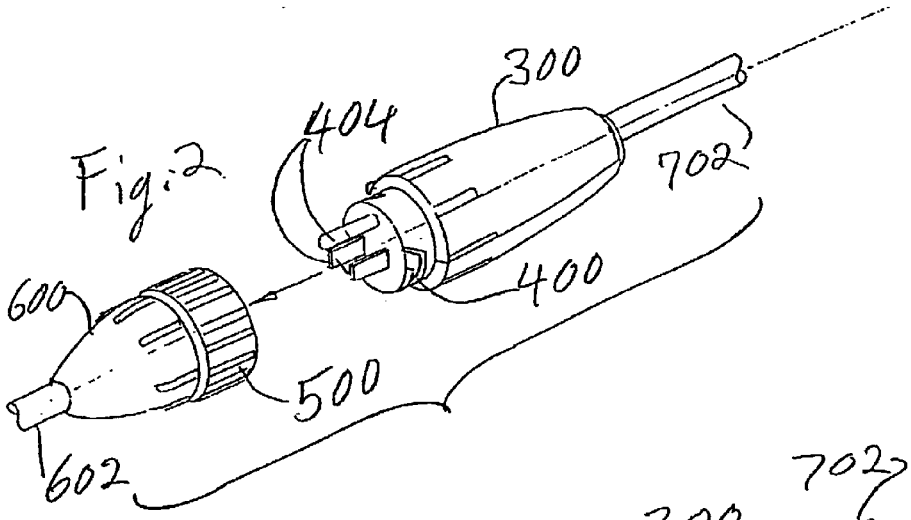
FIG. 2 is a perspective view.

FIG. 2 illustrates the assembled connection housing 300 with the prongs 404 of the adapter 400 ready to mate with the socket 600, and the sleeve 500 in its retracted or reserve position.

Figure 3:
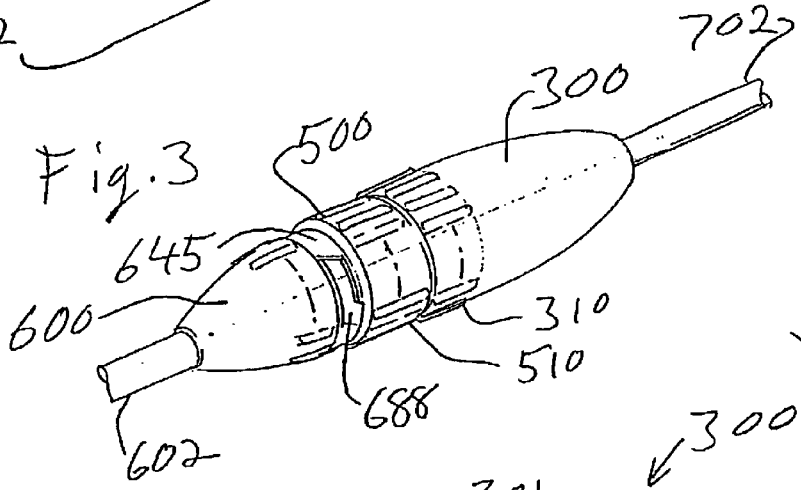
FIG. 3 is a exploded perspective view.

FIG. 3 illustrates electrical connection made and the invention locked. The sleeve 500 is in its extended or locking position, and the cable 602 is both electrically and mechanically fixed to the cord 702. A groove 688 in a cylindrical surface 645, as explained below, can be seen.

Figures 4, 5, 6:
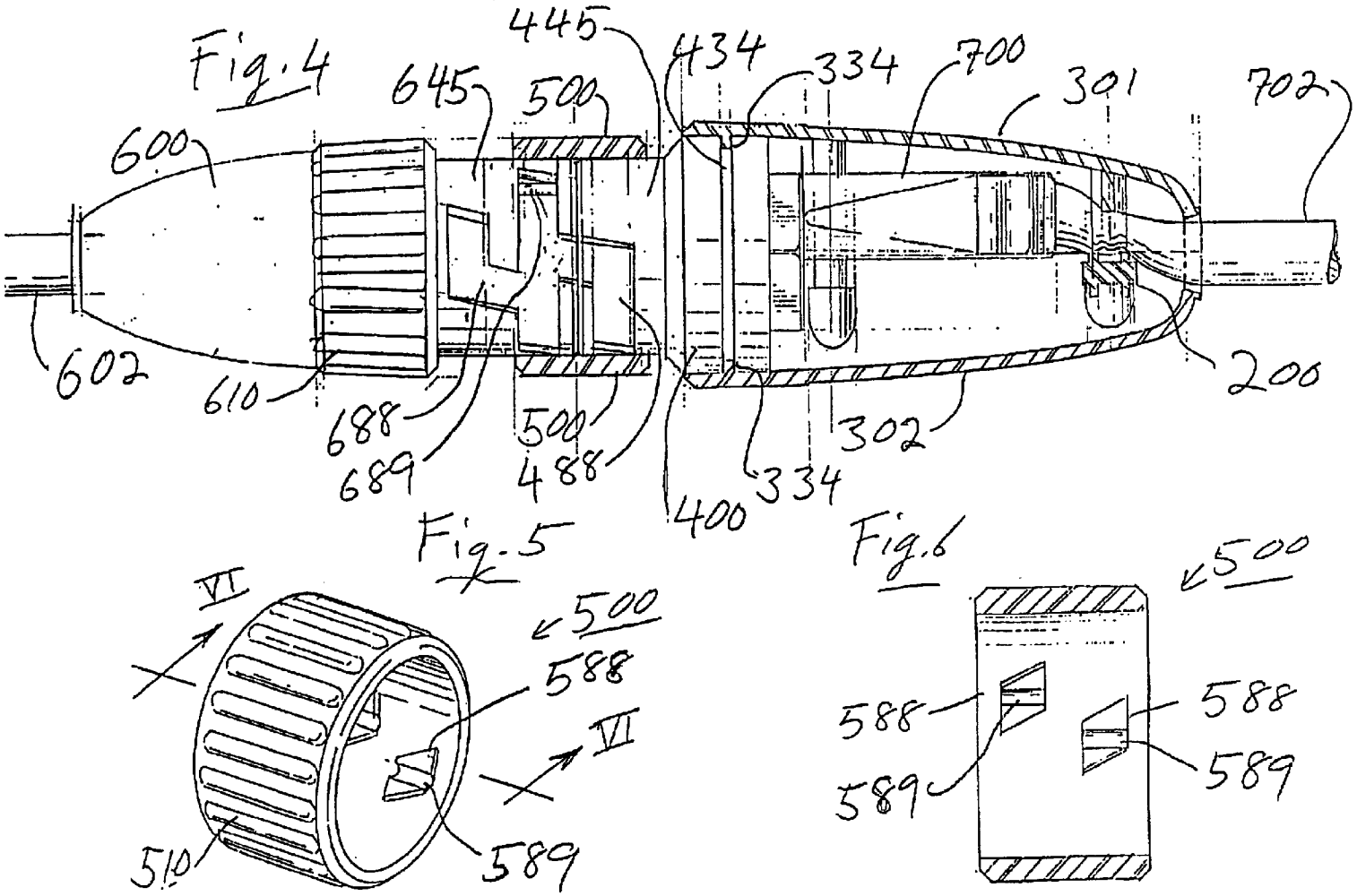
FIG. 4 is a cut-away, partially cross-sectional view.
FIG. 5 is an exploded perspective view of a first component of the invention.
FIG. 6 is a sectioned view in direction VI—VI of FIG. 5.

FIG. 4 shows the housing halves 301 and 302 and the sleeve 500 in cross sectioned view but the other components in plan view. The cord clamp 200 (which is also shown exploded in FIG. 1) is shown holding the cord 702, and the face of the plug 700 is flush against the mating face of the adapter 400 (the adapter face that is hidden in FIG. 1). It will be understood that the socket 600 contains female connector parts, to mate with the prongs 404, and that these open onto the mating face of the adapter 400. To the left of that face is the annular groove 434; sections of the annular flange 334, fitting into the groove 434, are visible at top and bottom. The adapter 400 is firmly held because the screws 399 keep the flange 334 seated in the groove 434.

The lock or locking mechanism includes first surface grooves 688 in a cylindrical surface of the socket 600, which surface is denoted as the first barrel 645, and second surface groove 488 in a cylindrical surface of the socket adapter 400, denoted as the second barrel 445. The two barrels 445 and 645 are axially aligned when the connector is assembled, forming together a single cylinder, and the grooves 488, 688 are aligned at the mating juncture of the adapter 400 and the socket 600, as shown in FIG. 4. The groove alignment is ensured by the angular alignment of the barrels, due to the orientation of the prongs 404 relative to the socket 600.

FIGS. 5 and 6 show, on the inside cylindrical surface of the sleeve 500, lugs 588 which engage in the grooves 688 and 488 shown in FIG. 4. Preferably, one or more of the lugs 588 includes a snap-depression 589 that mates with a snap-ridge 689 raised from the bottom of one of the grooves. The snap-ridge 689 is preferably located in a position such that snap-in engagement takes place when the sleeve 500 is in a locking position. If desired, a snap-ridge can also hold the sleeve in a reserve position as well.

FIGS. 4–6 show only half of the preferred grooves and lugs, namely those on only one side of the barrels 445, 645 and the sleeve 500. Similarly grooves and lugs may be on the other side which is not visible. The bilateral structure is visible in FIGS. 7–10, discussed below.

It will be apparent from a study of FIG. 4 that when the sleeve 500 is in the position of FIG. 2, one of the lugs 588 will be seated at the end of the vertical portion of the groove 688, that is left-most in FIG. 4; and that the sleeve 500 will be held from moving to the right. The second lug 588 is, at the same time, in the next vertical groove 688. If the sleeve 500 is then rotated so that the first lug 588 moves down in FIG. 4, it reaches a position from which it can move to the right along the generally horizontal groove. At the same time, the second lug is poised to move along another horizontal groove (keeping in mind that the relative positions of the lugs will be opposite to that shown in FIG. 6, because the lugs engaging the grooves of FIG. 4 are on the other side of the sleeve 500 from those shown in FIG. 6, and the lug on the right is thus higher instead of lower). So, the user can twist the sleeve 500 and slide it to the right.

As the sleeve 500 slides to the right, the right-hand lug 588 moves across the border between the first barrel 645 and the second barrel 445, and traverses from the groove 688 to the groove 488. Then, a second twist of the sleeve 500 by the user causes the second or right-hand lug 588 to move downward in FIG. 4 to the bottom of the vertical portion of the groove 488. Because the left-hand lug 588 is within the groove 688, the adapter 400 cannot be retracted from the socket 600: the adapter 400 is locked to the socket 600. Thus, the conductor cable 602 is securely but releasably locked to the power cord 702.

To aide the user in relatively rotating the sleeve 500, the socket 600, and the housing 300, each of these parts is preferably provided with knurling in the form of axially-oriented ridges 510, 610, and 310. Indicia of various positions of the sleeve, such as the reserve and locked positions, can be provided. For example, the knurling 310 on the housing 300 and the knurling 510 on the sleeve 500 may each be interrupted over a short arc, so that alignment of these knurling gaps serves as a marker for the locked position. The gaps are shown in FIG. 3.

The second barrel 445 is preferably the same diameter as the first barrel 645, but need not be (the sleeve 500 can include an internal step, for instance). However, it is preferred that the second barrel 445 be shaped such that the adapter can mate with conventional sockets, as well as with the socket 600 of the present invention. Then, the housing 300 will not need to be removed before using the appliance (not shown) connected to the cord 702. Moreover, the housing 300 is preferably compact enough that the invention can be used with sockets as closely spaced as those of an ordinary two-gang or four-gang wall socket.

The preferred outline shape of the lugs 588 is trapezoidal or diamond-shaped, as shown, because that maximizes the bearing length along a circumference. However, the lugs may be of any shape that will negotiate the grooves 688 and 488.

Figures 7, 8, 9, 10:
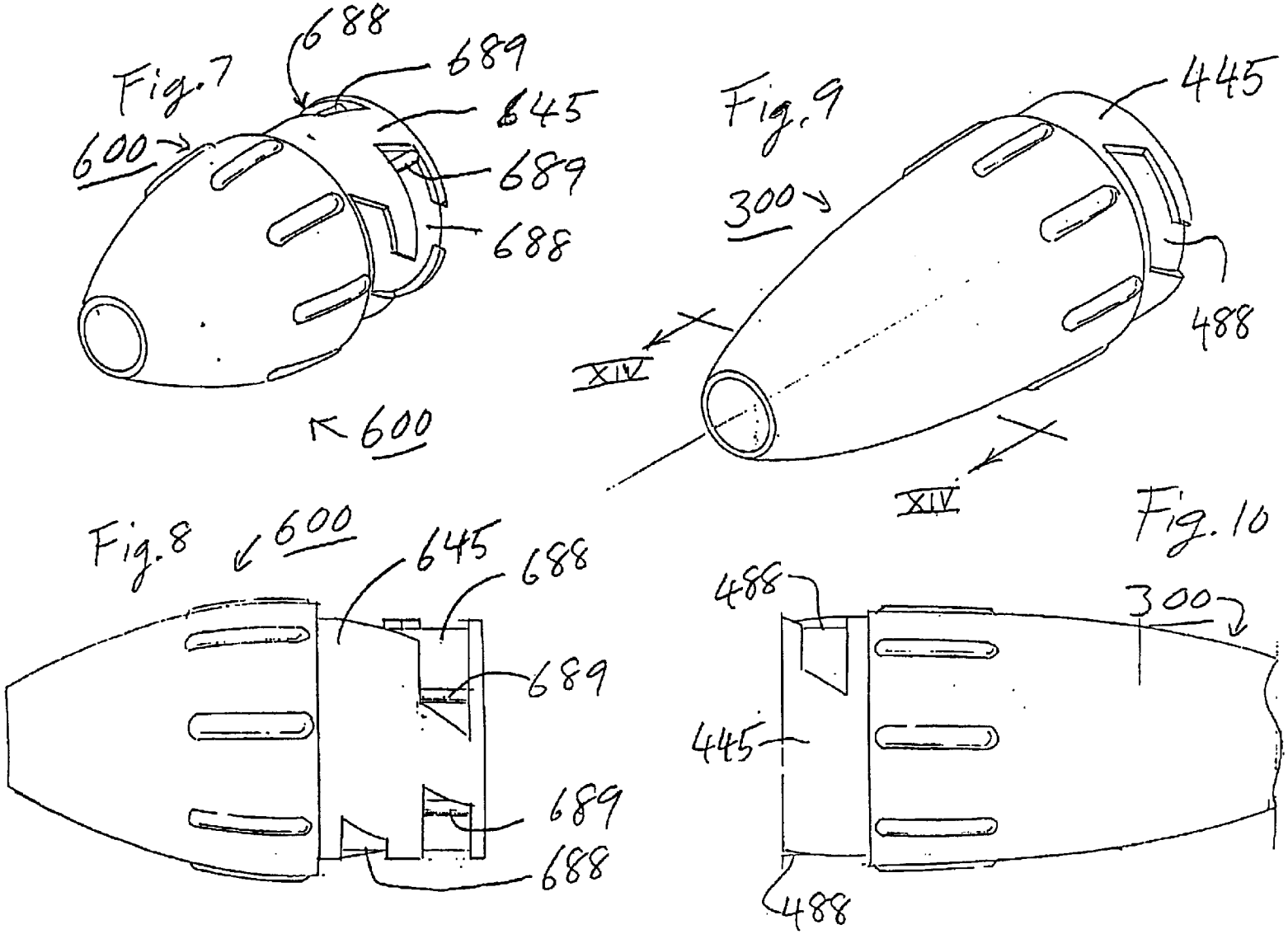
FIG. 7 is a perspective view of a second component.
FIG. 8 is a side view of the second component.
FIG. 9 is a perspective view of a third component.
FIG. 10 is a side view of the third component.

FIGS. 7–10 show the structures also shown in FIG. 4. In FIGS. 7 and 8 double grooves 688 are visible. These are preferably bilaterally symmetrical. The snap-ridges 689 at either end of the groove 688 nearest to the mating face serve to engage the snap-depression 589 and to lock the sleeve 500 (not shown in FIGS. 7–10) into its reserve and locking positions.

FIG. 9 shows one of the two grooves 488 in the second barrel 445, and in FIG. 10*a* corner of another groove 488 is visible at the bottom.

Figure 11:
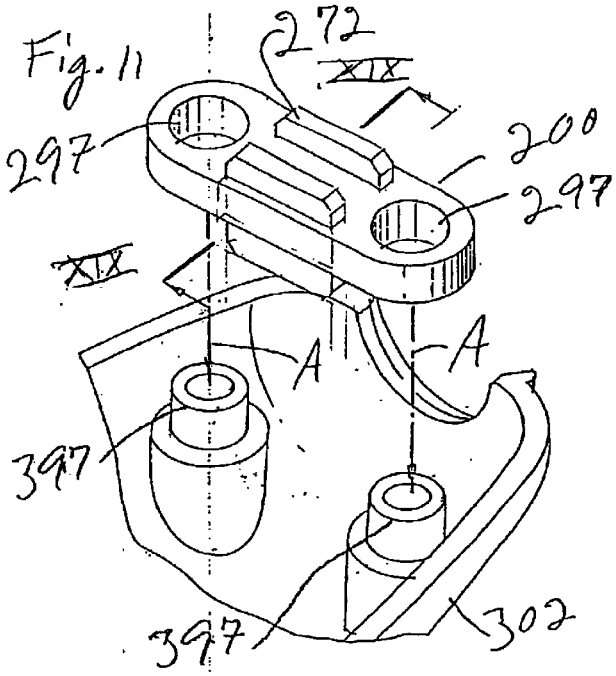
FIG. 11 is a detailed perspective partial view of the third component and of a fourth component.
Figure 12:
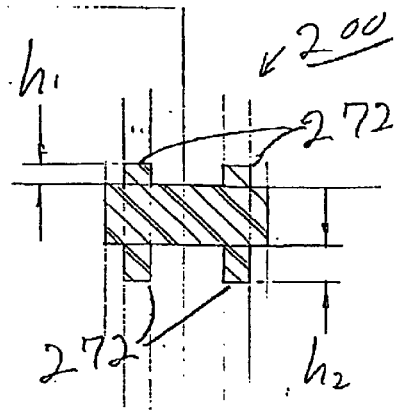
FIG. 12 is a cross-sectional view along lines XIX—XIX of FIG. 11.

FIG. 11 shows a portion of the interior of the half-housing 302 with arrows A indicating the motion of the cord clamp 200 downward onto screw pedestals 397, where holes 297 in the cord clamp 200 slide onto the narrower upper portions of the pedestals 397, so that the bottom of the cord clamp 200 will rest against the shoulders of the pedestals 397. The cord clamp 200 includes four gripping splines 272, which are of different heights $h_1$ and $h_2$, as seen in cross-sectional FIG. 12. With this feature, the cord 702 can be gripped more or less tightly by turning over the cord clamp 200 prior to assembling the connection housing.

Figure 13:
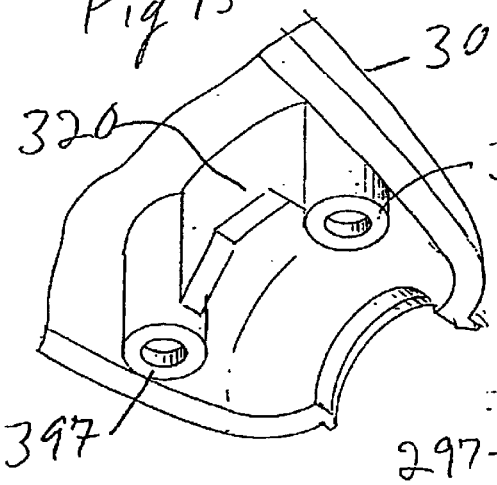
FIG. 13 is a detailed perspective partial view of a fifth component.

FIG. 13 shows the upper half-housing 301 which also includes pedestals 397. Preferably, the pedestals 397 of the lower half-housing 302 have through-holes to pass the screws 399, but the upper pedestals 397 have blind holes for self-tapping plastic screws. The upper half-housing also includes a cord-gripping bridge 320.

Figure 14:
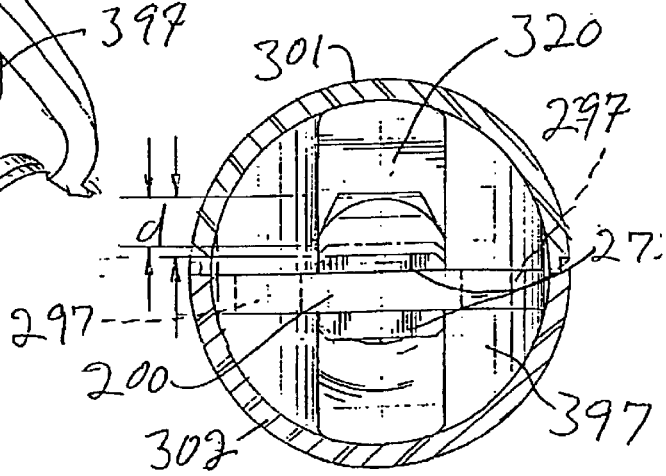
FIG. 14 is a cross-sectional view along lines XIV—XIV of FIG. 9.

FIG. 14 shows the structures which grip the cord 702. A gap d is formed between the bridge 320 and the splines 272.

That gap is adjustable to better grip the cord 702, by inverting the cord clamp 200.

In alternate embodiments of the invention the socket-to-adapter locking mechanism may take different forms, such as screw threads, latches, snap-structures, screws and so on. Most of the alternate embodiments contemplated for the present invention will include a cylindrical sleeve, but others will not. Any device, structure, or means which will releasably lock an adapter to a socket is within the scope of the present invention.

Similarly, the connection housing 300 may be embodied in different ways. Any housing or other connector which will releasably lock an adapter to a plug is within the scope of the present invention. The connection housing 300 may be replaced by a device of open design, one that grips only the body of the plug 700, or one that grips only the cord 702.

The present invention can be used with a gang-box extension cord, where the gang-box with sockets is massive enough to hinder movements that might pull out its male plug. Such a gang-box can also include mechanical hold-down means, such as a bracket or tab that takes a hold-down screw. The invention as embodied above can be used on a wall socket or the like with appropriate modification of the socket portion. In that embodiment the cable will be the cable feeding the socket, which may be permanently installed in a wall or in a conduit, and the socket body may be a regular metal or plastic connection box.

The concept of the present invention is intended primarily for AC line grid power cables, but it is not restricted to AC grid power lines. It can be used for signal connectors and for couplings for different voltages, DC as well as AC, and so on.

Although certain presently preferred embodiments of the present invention have been specifically described herein, it will be apparent to those skilled in the art to which the invention pertains that variations and modifications of the various embodiments shown and described herein may be made without departing from the spirit and scope of the invention. Accordingly, it is intended that the invention be limited only to the extent required by the appended claims and the applicable rules of law.

Infinitive verbs (e.g., "to cover") in the following claims are intended not to invoke 35 U.S.C. § 112, 6th paragraph, and to differ from language which would invoke 35 U.S.C., 6th paragraph (e.g., "means for covering").

What is claimed is:

1. A coupling system for coupling a power cord to a conductor cable wherein:

the power cord includes a male plug, the plug having an exterior shape;

a conductor cable having a female socket electrically coupled to an end of the cable;

an adapter comprising a male end matable with the female socket and a female end matable with the male plug of the power cord;

a lock releasably holding the adapter to the socket; and a connector fastening the adapter to the plug, said connector comprising a cord clamp;

whereby, while the adapter remains fastened to the plug, the cable is securely but releasably locked to the power cord.

2. The coupling system according to claim 1 wherein the clamp is adapted to the shape of the plug.

3. The coupling system according to claim 1 wherein the connector comprises a housing covering the plug of the power cord, and the plug is contained within the housing.

4. The coupling system according to claim 3, wherein the housing comprises an upper half and a lower half.

5. The coupling system according to claim 4, wherein the clamp comprises a cord-gripping bridge in the upper half and the cord is clamped by the bridge when the upper half is fastened to the lower half.

6. The coupling system according to claim 3, wherein the clamp comprises a cord clamp mountable inside the housing, the cord clamp being invertible, and comprising splines of different heights on two sides thereof, whereby the cord is clamped more or less tightly depending on inversion of the cord clamp.

7. The coupling system according to claim 1, wherein the lock comprises a coupling sleeve rotatable to lock the socket to the adapter.

8. The coupling system according to claim 1, wherein the socket comprises a socket housing, the cable extends from a first end of the socket housing, and the adapter mates with a second end of the socket housing.

9. A coupling system for coupling a power cord to a conductor cable wherein:

the power cord includes a male plug, the plug having an exterior shape;

a conductor cable having a female socket electrically coupled to an end of the cable;

an adapter comprising a male end matable with the female socket and a female end matable with the male plug of the power cord;

a lock releasably holding the adapter to the socket;

a connector fastening the adapter to the plug;

whereby, while the adapter remains fastened to the plug, the cable is securely but releasably locked to the power cord;

wherein the lock comprises a generally cylindrical socket first barrel and a generally cylindrical adapter second barrel;

a coupling sleeve movable over the first barrel and the second barrel when the adapter is mated with the socket; and wherein the first barrel, the second barrel, and the coupling sleeve comprise surface lugs and grooves to lock the first barrel to the second barrel when the coupling sleeve is disposed in a locking position.

10. The coupling system according to claim 9, further comprising snaps holding the coupling sleeve in the locking position.

11. The coupling system according to claim 10, wherein the lugs and the grooves comprise the snaps.

12. A coupling system for coupling a power cord to a conductor cable wherein:

the power cord includes a male plug, the plug having an exterior shape;

a conductor cable having a female socket electrically coupled to an end of the cable;

an adapter having an adapter body comprising a male end matable with the female socket and a female end matable with the male plug of the power cord;

a lock releasably holding the adapter to the socket; and a connector fastening the adapter body to the male plug, and the adapter body having a groove lockably receiving the female socket.

13. A coupling system for coupling a power cord to a conductor cable wherein:

the power cord includes a male plug, the plug having an exterior shape;

a conductor cable having a female socket electrically coupled to an end of the cable;

an adapter comprising a male end matable with the female socket and a female end matable with the male plug of the power cord;

a lock releasably holding the adapter to the socket; and a connector fastening the adapter to the plug, said connector comprising a clamp and a housing covering the plug of the power cord, said plug being contained within the housing;

whereby, while the adapter remains fastened to the plug, the cable is securely but releasably locked to the power cord.

14. The coupling system according to claim 13, wherein the housing comprises an upper half and a lower half.

15. The coupling system according to claim 14, wherein the clamp comprises a cord-gripping bridge in the upper half and the cord is clamped by the bridge when the upper half is fastened to the lower half.

16. The coupling system according to claim 13, wherein the clamp comprises a cord clamp mountable inside the housing, the cord clamp being invertible, and comprising splines of different heights on two sides thereof, whereby the cord is clamped more or less tightly depending on inversion of the cord clamp.

17. A coupling system for coupling a power cord to a conductor cable wherein:

the power cord includes a male plug, the plug having an exterior shape;

a conductor cable having a female socket electrically coupled to an end of the cable;

an adapter comprising a male end matable with the female socket and a female end matable with the male plug of the power cord;

a lock releasably holding the adapter to the socket, said lock comprising a coupling sleeve rotatable to lock the socket to the adapter; and a connector fastening the adapter to the plug;

whereby, while the adapter remains fastened to the plug, the cable is securely but releasably locked to the power cord.

* * * * *